US009551547B2

(12) United States Patent
Aberg

(10) Patent No.: US 9,551,547 B2
(45) Date of Patent: Jan. 24, 2017

(54) REPEATABLE PLASMA GENERATOR AND METHOD FOR THE SAME

(71) Applicant: BAE Systems Bofors AB, Karlskoga (SE)

(72) Inventor: Denny Aberg, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 78 days.

(21) Appl. No.: 14/368,925

(22) PCT Filed: Dec. 17, 2012

(86) PCT No.: PCT/SE2012/000206

§ 371 (c)(1),
(2) Date: Jun. 26, 2014

(87) PCT Pub. No.: WO2013/100835

PCT Pub. Date: Jul. 4, 2013

(65) Prior Publication Data

US 2014/0352564 A1 Dec. 4, 2014

(30) Foreign Application Priority Data

Dec. 29, 2011 (SE) ..... 1130128

(51) Int. Cl.
*F42C 19/12* (2006.01)
*F41A 19/63* (2006.01)
(Continued)

(52) U.S. Cl.
CPC ..... *F41A 19/63* (2013.01); *F41A 19/60* (2013.01); *F42B 3/14* (2013.01); *F42C 19/0811* (2013.01);
(Continued)

(58) Field of Classification Search
CPC ..... F42B 6/006; F42C 19/0811
See application file for complete search history.

(56) References Cited

U.S. PATENT DOCUMENTS 5,444,208 A * 8/1995 Mortensen ..... F42B 5/08 102/202.8
5,898,124 A 4/1999 Krumm et al.
(Continued)

FOREIGN PATENT DOCUMENTS

GB 2 276 801 A 10/1994
JP 07296993 A 11/1995
WO WO-2012/082039 A1 6/2012

OTHER PUBLICATIONS

Extended European Search Report issued Aug. 4, 2015 in EP Appln. No. 12862246.

*Primary Examiner* — Gabriel Klein
(74) *Attorney, Agent, or Firm* — Polsinelli PC

(57) ABSTRACT

The invention relates to a method for the repeatable initiation of propellent charges in a weapon system, for example in the firing of projectiles from a barrel weapon, through electrical discharge between a rear electrode (22) and a front electrode (21) in a combustion chamber channel (3) filled with filler gas and comprising a combustion chamber combustion element (30), in which the filler gas in the combustion chamber channel (3) is ionized via a high-voltage potential from at least one ionizing electrode (100, 101, 102, 103), which ionization increases the electrical conductivity in the combustion chamber channel (3) so that an electrical flashover, through electrical discharge via a high-voltage generator (5) between the rear electrode (22) and the front electrode (21), is generated from the rear electrode (22) via at least one ionizing electrode (100, 101, 102, 103) onward to the front electrode (21), which results in hot ignition gas with plasma-like state being expelled from the combustion
(Continued)

chamber channel (3). The invention also relates to a plasma generator for the said method, and to an ammunition unit comprising the said plasma generator.

13 Claims, 3 Drawing Sheets

(51) Int. Cl.

| | |
|---|---|
| ***H05H 1/52*** | (2006.01) |
| ***F41A 19/60*** | (2006.01) |
| ***H05H 1/34*** | (2006.01) |
| ***F42C 19/08*** | (2006.01) |
| ***F42B 3/14*** | (2006.01) |
| *F42B 5/08* | (2006.01) |

(52) U.S. Cl.
CPC ..... *F42C 19/12* (2013.01); *H05H 1/34* (2013.01); *H05H 1/52* (2013.01); *F42B 5/08* (2013.01)

(56) References Cited

U.S. PATENT DOCUMENTS

| | | | | |
|---|---|---|---|---|
| 5,945,623 | A * | 8/1999 | Goldstein | F41B 6/00 102/202.8 |
| 6,805,055 | B1 | 10/2004 | Jebsen et al. | |
| 2002/0134767 | A1 | 9/2002 | Brunet et al. | |
| 2002/0157559 | A1* | 10/2002 | Brunet | C06B 27/00 102/472 |
| 2011/0061555 | A1 | 3/2011 | Gustavsson et al. | |
| 2011/0155011 | A1 | 6/2011 | Stark et al. | |
| 2014/0083317 | A1* | 3/2014 | Aberg | F41A 19/63 102/202 |

* cited by examiner

REPEATABLE PLASMA GENERATOR AND METHOD FOR THE SAME

CROSS REFERENCE TO RELATED APPLICATIONS

This application is a National Phase filing under 35 U.S.C. §371 of PCT/SE2012/000206 filed on Dec. 17, 2012; and this application claims priority to Application No. 1130128-0 filed in Sweden on Dec. 29, 2011 under 35 U.S.C. §119; the entire contents of all are hereby incorporated by reference.

The present invention relates to an improved plasma generator for the repeatable initiation of propellent charges in a weapon system, for example in the firing of projectiles from a barrel weapon, through electrical discharge in a combustion chamber enclosure comprising a combustion chamber channel and a combustion chamber combustion element disposed adjacent to a propellent charge, as well as to a method for the same.

The invention also relates to an ammunition unit comprising a repeatable plasma generator for initiating propellent charges in the firing of projectiles from a barrel weapon.

A conventional barrel weapon here refers to a weapon of the artillery gun, naval gun or tank gun type, or other gun comprising a barrel in which a projectile is fired and propelled through the barrel by a propellent charge which is ignited with the aid of a pyrotechnic initiator, for example a percussion primer, priming cartridge, etc. The propellent charge, also referred to as propellant, here refers to a gunpowder in solid form, which during combustion gives off gases which, under high pressure inside the barrel, drive the projectile forwards towards the muzzle of the barrel. The propellant can also be of a type other than solid gunpowder.

High gas pressure over a long period means that a high muzzle velocity for the projectile can be achieved. High muzzle velocity for the projectile is used, for example, to increase the range of the weapon, improve the penetrability of the projectile or reduce the time passage of a projectile trajectory.

A pressure curve for an optimal combustion process, and thus high firing velocity, should exhibit an almost immediate pressure increase to $P_{max}$, thereafter a lasting plateau phase with a maintained constant barrel pressure at $P_{max}$ throughout the time that the propellent charge burns inside the barrel, so as then immediately to fall to zero when the projectile leaves the barrel. All propellent charge will then normally have burnt up.

Regardless of the choice of propellent charge, the ignition process is of great relevance to the pressure pattern, and thus the primer and the ignition system are critical to the attainment of high firing velocity.

At the same time as the highest possible firing velocity is desired, there is a need to reduce the vulnerability of the propellant. Propellants of this type are referred to as LOw-VulnerAbility (LOVA). Low-vulnerability propellants are difficult to ignite, which reduces the risk of accidental initiation of propellant in risk situations, for example when a combat vehicle comes under enemy fire. The reduced vulnerability also results in increased demands upon the primers. The primers must then generate an increased quantity of energy and/or increased pressure in order to create the ignition process. The primers normally consist of an easily initiated priming agent, and if the quantity of priming agent is increased, then this is in direct contrast to the introduction of LOVA-type propellant. In principle, ignition is realized by an ignition chain, in which a very small quantity of vulnerable priming agent, referred to as primary composition, for example lead azide or silver azide, is ignited by mechanical shock or electrical impulse. The primary composition then ignites the secondary composition of the primer, usually black powder, wherein the propellant is initiated. By replacing the pyrotechnic initiator or the whole of the ignition chain with a plasma torch, the vulnerability of the system to accidental initiation is reduced. At the same time an increased dynamic is enabled in order to generate the stronger ignition impulses which are required to ignite low-vulnerability propellant (LOVA).

Conventional primers also comprise a logistical and technical problem. For barrel weapons which use propellent charges separated from the projectiles, such as, for example, artillery and cruder ships' cannons, a separate priming cartridge is often used to initiate the propellant. For each firing, a priming cartridge is used. There is thus a need for a mechanical system mounted on the cannon for housing, loading and removal of the priming cartridge. Through the use of plasma torches, the logistical problems surrounding a priming cartridge are avoided. A common problem is that the priming cartridge jams in the cartridge position. The priming cartridge expands upon firing of the weapon system, whereupon the priming cartridge becomes wedged in the cartridge position and the fire is interrupted. Through the introduction of a plasma torch, any fire interruption is avoided and functional reliability increases.

Plasma torches for initiating propellent charges are described, for example, in patent documents U.S. Pat. No. 5,231,242(A) and U.S. Pat. No. 6,703,580(B2). The plasma torches are based on the principle of exploding wires, that is to say an electrically conducting wire which is heated, vaporized and partially ionized by an electric current. The drawback is that the wire is consumed and must be replaced by a new one before each firing. The plasma torch is therefore of the single-use type.

Repeatable plasma torches are known, for example, through patent documents DE-103 35 890 (A1) and DE-40 411 (A1). The plasma torches are based on the principle that an electrically conducting liquid is injected between two electrodes having a difference in electrical potential, wherein the electrical circuit is shorted and generates a discharge and plasma generation. The use of liquids entails complicated devices for dosage and supply, as well as problems with possibly toxic, energetic or easily ignitable substances. The use of liquids also calls for complicated logistics for the handling of liquids.

Swedish patent application SE 1001194-8 shows a plasma torch having ionizing electrodes for ionizing a combustion chamber combustion element in which the ionization results in the enablement of an electrical flashover between two electrodes. The proposed plasma torch is only partially adaptable to different plasma torch lengths and different ignition energies.

One object of the present invention is to solve the above-identified problems.

A further object of the present invention is an improved method for the repeatable initiation of propellent charges in a weapon system, in which complicated dosage and supply of liquids between electrodes is avoided.

A further object of the present invention is an improved plasma generator for the repeatable initiation of propellent charges in a weapon system, in which complicated devices for the dosage and supply of liquids between electrodes are avoided.

A further object of the present invention is an improved plasma generator for the repeatable initiation of propellent charges in a weapon system, in which the length and ignition energy of the plasma generator can be adapted.

Yet another object of the present invention is an ammunition unit comprising the said improved plasma generator.

The said objects, as well as other objects which are not enumerated here, are satisfactorily met within the scope of what is stated in the present patent claims.

Thus, according to the present invention, an improved method has been provided for the repeatable initiation of propellent charges in a weapon system, for example in the firing of a projectile from a firing device, through electrical discharge in a combustion chamber channel comprising a combustion chamber combustion element.

The invention relates to a method for the repeatable initiation of propellent charges in a weapon system, for example in the firing of projectiles from a barrel weapon, through electrical discharge between a rear electrode and a front electrode in a combustion chamber channel filled with filler gas and comprising a combustion chamber combustion element, in which the filler gas in the combustion chamber channel is ionized via a high-voltage potential from at least one ionizing electrode, which ionization increases the electrical conductivity in the combustion chamber channel so that an electrical flashover, through electrical discharge via a high-voltage generator between the rear electrode and the front electrode, is generated from the rear electrode via at least one ionizing electrode onward to the front electrode, which results in hot ignition gas with plasma-like state being expelled from the combustion chamber channel.

According to further aspects of the improved method for the repeatable initiation of propellent charges in a weapon system according to the invention:

the electrical flashover, through electrical discharge via the high-voltage generator between the rear electrode and the front electrode, is generated from the rear electrode via at least one ionizing electrode onward to the front electrode, by virtue of the fact that the step-by-step electrical flashovers, from the rear electrode via the ionizing electrodes to the front electrode, initiate the next flashover through further ionization of the filler gas by UV light created by the said electrical flashover, together with displacement of the electrical field from the rear electrode towards the front electrode via the ionizing electrodes;

the electrical discharge through the combustion chamber channel is propagated through the plasma generator;

(a) from the rear electrode to the first ionizing electrode, (b) from the first ionizing electrode to the second ionizing electrode, (c) from the second ionizing electrode to the third ionizing electrode, (d) from the third ionizing electrode to the fourth ionizing electrode, (e) from the fourth ionizing electrode to the front electrode;

the electrical discharge of the electrical energy in the high-voltage generator is realized between the rear electrode and the front electrode and to the filler gas in the combustion chamber channel through the ionization of the filler gas by the electrical discharge;

the electrical discharge from the high-voltage generator is realized when the conductivity in the combustion chamber channel is sufficient to generate an electrical flashover;

the ionizing electrodes are resistively connected to earth.

The neutral filler gas can be constituted by atmospheric gas or residual gas from previous firing. The electrical discharge can be constituted by a surface flashover, volume breakdown, or a transition from surface flashover from bound charges in the surface of the combustion chamber combustion element to volume breakdown in the combustion chamber channel. The volume breakdown in the combustion chamber channel and the subsequent power dissipation raises the gas pressure in the combustion chamber and energy is released via recombination between free electrons and ions, as well as neutrals to photons, which dissociate and ionize the filler gas as well as the surface of the combustion chamber combustion element. This surface thus gives off gas to the combustion chamber channel, which further raises the pressure and supplies further neutrals to the volume, which has a slowing effect on the impedance collapse which takes place in the combustion chamber channel and increases the electric power component in the combustion chamber as the impedance does not move towards zero as is the case with gas discharges in open geometry. The pressure and temperature increase in the combustion chamber expels hot ignition gas with plasma-like and electrically conducting properties from the bushing of one terminal, so as to reach the propellant to be initiated.

Furthermore, according to the present invention, an improved plasma generator for the repeatable initiation of propellent charges in a weapon system, for example in the firing of projectiles from a barrel weapon, through electrical discharge between a rear electrode and a front electrode in a combustion chamber channel, comprising a combustion chamber combustion element and filled with filler gas, and disposed adjacent to a propellent charge, the plasma generator comprising at least one ionizing electrode connected to an initiation circuit for ionizing the filler gas in the combustion chamber channel, as well as a second high-voltage generator arranged for electrical discharge into the electrically conducting gas from the rear electrode via at least one ionizing electrode onward to the front electrode, so that hot ignition gas is formed under high pressure.

According to further aspects of the improved plasma generator according to the invention:

the initiation circuit comprises at least a first high-voltage generator and at least one circuit breaker connected to the first terminal of at least one capacitor, wherein the ionizing electrode is connected to the second terminal of the said capacitor by an at least one resistor comprised in an electrical circuit;

the initiation circuit, in addition to the resistor connected to the second terminal of the capacitor, comprises at least one inductor connected between the ionizing electrode and the resistor;

the ionizing electrodes are fixed to the combustion chamber combustion element, wherein the ionizing electrodes are in open contact with the combustion chamber channel and are electrically connected to the initiation circuit;

the ionizing electrodes are distributed with mutually equal spacing in the axial direction of the combustion chamber channel;

the ionizing electrodes are distributed with equal spacing around the centre axis of the combustion chamber channel;

the ionizing electrodes are four in number;

the rear electrode disposed on the rear end of the combustion chamber channel is electrically connected to the second high-voltage generator, and the front electrode disposed on the front end of the combustion chamber channel is connected to earth, which rear and front electrodes are made of an electrically conducting material, and in the front electrode is disposed a gas outlet, which opens out towards the propellent charge;

the gas outlet is a convergent nozzle;
the gas outlet is a divergent nozzle;
the gas outlet is a convergent-divergent nozzle;
the combustion chamber combustion element is made of a material which is not consumed in the initiation of the plasma generator.

Furthermore, according to the present invention, an improved ammunition unit comprising a shell casing, a projectile, a propellent charge and a priming device has been provided, which priming device is constituted by a plasma generator.

The invention will be described in greater detail below with reference to the appended figures, in which.

Figure 1:
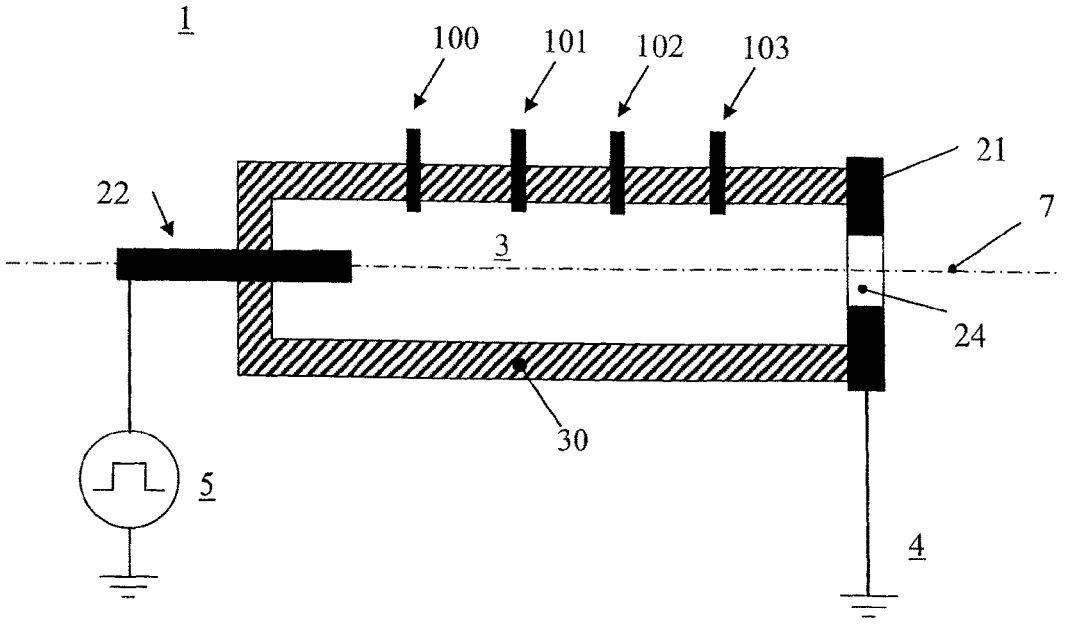
FIG. 1 shows in schematic representation a longitudinal section of a repeatable plasma generator according to the invention.

The plasma generator 1 which is shown in FIG. 1 comprises a front electrode 21, a combustion chamber combustion element 30 comprising a combustion chamber channel 3, and a rear electrode 22. The plasma generator 1 further comprises a number of, in the figure four, ionizing electrodes 100, 101, 102 and 103. The ionizing electrodes are connected to the initiation circuit 99 (not shown in FIG. 1).

The combustion chamber combustion element 30, preferably tubular, is a part of the plasma generator 1 and forms the combustion chamber channel 3 of the plasma generator. The combustion chamber channel 3 extends axially through the plasma generator between a front electrode 21 and a rear electrode 22. The front part of the combustion chamber channel 3, i.e. the gas outlet 24 of the plasma generator 1, is preferably configured as a nozzle mounted or directly worked in the front electrode 21. The front electrode 21 is connected to an electrical earth 4. The rear electrode 22 is electrically connected to a high-voltage generator 5, also referred to as the second high-voltage generator, and mounted against the combustion chamber combustion element 30. One or more ionizing electrodes 100, 101, 102 and 103, wholly or partially enclosing the combustion chamber channel 3, are connected to an external initiation circuit 99 comprising an external high-voltage generator 2, also referred to as the first high-voltage generator. The ionizing electrodes 100, 101, 102 and 103 can be placed successively in a row, but also in part rotating about the centre axis 7. For an advantageous embodiment of the plasma generator 1, the size and placement of the ionizing electrodes are chosen such that all ionizing electrodes 100, 101, 102 and 103 are visible viewed from the short side of the plasma generator, in this case the ionizing electrodes being placed at various angles around the centre axis 7. The combustion chamber combustion element 30 can comprise a sacrificial material disposed between the front electrode 21 and the rear electrode 22, expediently in the shape of a tube.

Figure 2:
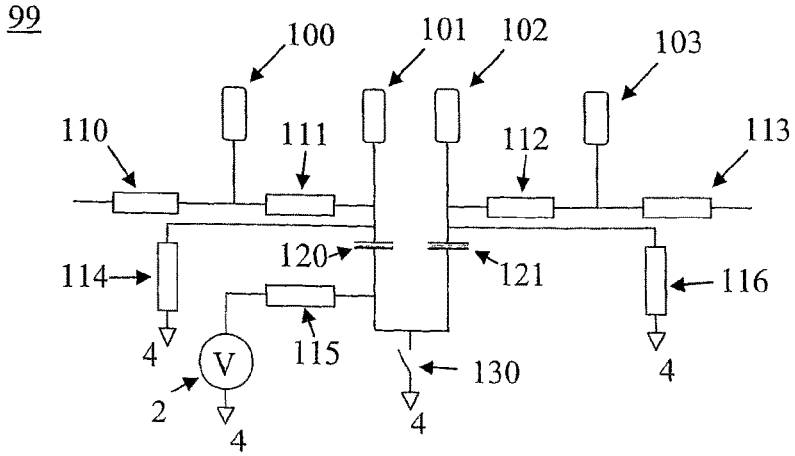
FIG. 2 shows a circuit diagram illustrating the connection of the electrodes according to the invention.

The electrical circuit diagram for the external initiation circuit 99 is described in FIG. 2. In FIG. 2 is shown how the ionizing electrodes 100, 101, 102 and 103 are connected up to the initiation circuit 99. Two high-voltage capacitors, 120 and 121, are charged to a high voltage with a high-voltage generator 2. The charging current is limited with a charging resistance 115. The charging resistance 115 also minimizes the discharging current to the high-voltage generator 2 from the capacitors 120 and 121. The connection point on the capacitors 120 and 121 which is connected to the high-voltage generator 2 is charged to a high-voltage potential. The opposite side of the capacitors 120, 121, the side which is not connected to the high-voltage generator, is connected to earth 4 by current-limiting resistors 114, 116. The resistors 114, 116 are designed to constitute, in the charging of the capacitors 120, 121, a current limitation, and also to act in the discharging of the capacitors 120, 121, and thus in the initiation of the plasma generator, as current limitation for the current impulse passing through the ionizing electrodes 100, 101, 102, 103. Between the ionizing electrodes 100, 101, 102, 103, current-limiting electrode resistors 110, 111, 112, 113 are connected. Where four ionizing electrodes 100, 101, 102, 103 are used, as shown in the diagram, only two of the electrode resistors 111, 112 are required. The electrode resistors 110 and 113 shown in the diagram are shown to illustrate how the circuit can be enlarged for the further connection of a greater number of ionizing electrodes than four. The number of ionizing electrodes can be freely chosen on the basis of the desired size, desired drive voltages and available and desired energy levels of the plasma generator 1. A circuit breaker 130, also referred to as a switch, can at a certain moment close the high-voltage side of the capacitor to earth. The circuit breaker 130 can be of the trigatron, spark gap or semiconductor type, or other types of circuit breaker. The resistors 114 and 116 prevent the discharge current from the second high-voltage generator 5 from being discharged through the ionizing electrodes. The electrical discharge is driven to pass from the rear electrode 22 to the front electrode 21 when the resistors 114 and 116, as well as the electrode resistors 110, 111, 112, 113, bar the current from passing to earth 4 through the initiation circuit 99.

Figure 3:
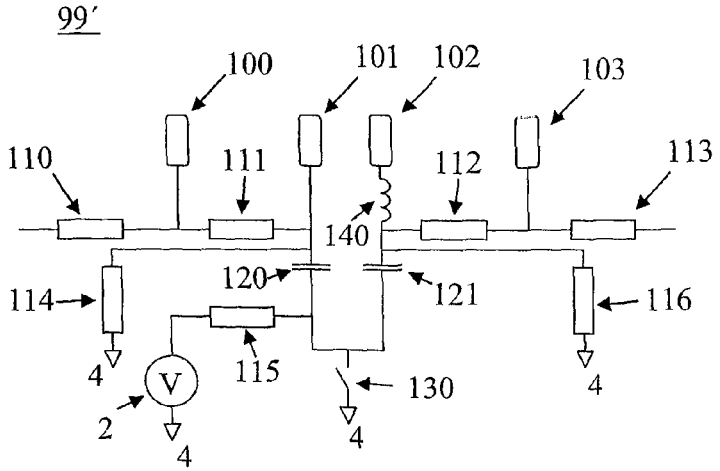
FIG. 3 shows an alternative circuit diagram illustrating the connection of the electrodes according to the invention.

In FIG. 3 is shown an alternative circuit diagram for an external initiation circuit 99', illustrating a connection of the ionizing electrodes 100, 101, 102, 103. In all electrical circuits, a certain inductance, also referred to as leakage inductances, is found, in which the inductances in the circuit affect how the electrical signals are propagated in the circuit. By introducing inductances 140 into the circuit from the ionizing electrodes located remotely from the rear electrode 22, the electrical flashover in the combustion chamber channel 3 can be controlled. The introduced inductances 140 are preferably greater than the leakage inductances present in the circuit.

Figure 4:
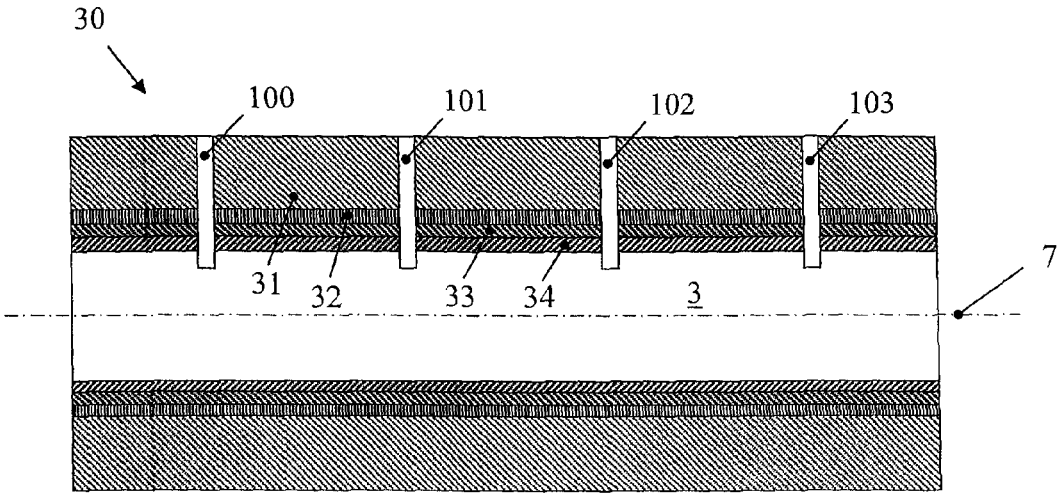
FIG. 4 shows a detailed enlargement of the combustion chamber combustion element in FIG. 1 according to the invention.

The combustion chamber combustion element 30 according to FIG. 4 is preferably configured to be consumed layer by layer by successive combustion of the three combustion element layers 32, 33 and 34 shown in FIG. 4. Additional combustion element layers can, of course, be present. Upon each initiation a layer is consumed, wherein each new energy impulse against that surface of the body 31 which is exposed in the combustion chamber channel 3 vaporizes the surface wholly or in part and generates a plasma created by the electrical discharge between the rear electrode 22 and the front electrode 21. The first impulse vaporizes the combustion element layer 34, wherein the combustion element layer 33 is laid bare to the combustion chamber channel 3. After this, the next impulse will vaporize the next layer 33, and so on. The vaporization can take place layer by layer in both the axial direction and the radial direction, but can also be realized by increased consumption of material around the ionizing electrodes 100, 101, 102, 103, and decreasing towards the front electrode 21 and the rear electrode 22.

Other wasting methods, too, are possible. The wholly or partially consumed combustion chamber combustion element 30 can be easily exchanged for a new one, according to requirement.

The combustion chamber combustion element 30 can be configured by, for example, lamination methods, in which a specific number of layers or plies are joined together in accordance with the number of ignition impulses which the plasma generator 1 is dimensioned to generate. The combustion chamber combustion element 30 can also be made of a homogenous material or of homogenous material in combination with lamination, or by sintering, pressing or other joining methods which are suitable for amalgamating metallic and polymeric materials, wherein the metallic material component accounts for in the order of magnitude of 10-50% by weight and the polymeric material component accounts for in the order of magnitude of 50-90% by weight. Variation of the energy quantity to the plasma generator can also be used to vaporize one or more plies in a laminated combustion chamber combustion element 30, or a varied mass in the combustion chamber combustion element 30 which is made of a homogenous material.

The filler gas in the combustion chamber channel 3 is ionized with the ionizing electrodes 100, 101, 102 and 103, which increases conductivity and enables the very strong electrical impulse triggered with specific time length, amplitude and shape between the front electrode 21 and the rear electrode 22, which electrical impulse causes the surface layer to be heated, vaporized and ionized wholly or in part, layer by layer or ply by ply, into plasma, warm gas and warm particles, wherein a predetermined plasma is made to flow out through the end muzzle opening 24 with a very high pressure and at a very high temperature and with a large quantity of gas and warm particles.

The combustion chamber combustion element 30 preferably comprises at least one sacrificial material, which at least in the formed plasma disintegrates into molecules, atoms or ions. Such a sacrificial material expediently contains, for example, hydrogen and carbon. For the generation of warm particles, metallic materials, in combination with, for example, hydrogen and carbon, can also be a part of the combustion chamber combustion element 30. The combustion chamber combustion element 30 in described embodiments is composed of at least one dielectric polymeric material, preferably a plastic with high melting temperature (preferably above 150° C.), high vaporization temperature (above 550° C., preferably above 800° C.) and low thermal conductivity (preferably below 0.3 W/mK). Especially suitable plastics comprise thermoplastics or hard plastics, for example polyethylene, fluoroplastic (such as polytetrafluoroethylene, etc.), polypropylene, etc., or polyester, epoxy or polyimides, etc., in order to provide that only one surface layer or ply 32, 33, 34 of the combustion chamber combustion element 30 is vaporized per energy impulse.

The sacrificial material in the combustion chamber combustion element 30 should preferably also be sublimating, i.e. pass directly from solid form to gaseous form. It is also conceivable to arrange various material plies, thicknesses, etc. into a laminated combustion chamber combustion element 30 in order to produce the said layer-by-layer 32, 33, 34 vaporization of the laminate in the combustion chamber combustion element 30. Or, by sintering, pressing or other joining methods, amalgamate metallic and/or polymeric materials into a combustion chamber combustion element 30 to produce the said layer-by-layer 32, 33, 34 vaporization of the laminate in the combustion chamber combustion element 30.

The inner and outer radii of the combustion chamber combustion element 30 are calculated, dimensioned and produced such that only the outermost, free surface layer or ply 32, 33, 34, i.e. that which is facing out from the, from the combustion chamber channel 3, exposed surface of the combustion chamber combustion element 30, between the front electrode 22 and the rear electrode 21, is vaporized upon each electrical impulse. Optimally, the combustion chamber combustion element 30 can be consumed in the course of the last plasma generation intended for the plasma generator 1.

Since the consumption of the combustion chamber combustion element may be thought to be dynamically variable between each use, depending on the embodiment of, for example, the propellant, the projectile, the ambient temperature or the nature of the target, the combustion chamber combustion element 30 is produced with a certain margin in order to be able to function within the embodiments conceivable for the application.

The combustion chamber combustion element 30 can also be made of, for example, a ceramic, semi-conducting ceramic, or other material such as a plastic or other substance which is not consumed upon initiation of the plasma generator 1. In the event of initiation of a plasma generator 1 having a non-wasting combustion chamber combustion element 30, the filler gas contained in the combustion chamber channel 3 will be ionized upon the electrical discharge. With a combustion chamber combustion element 30 made of a non-wasting material, the combustion chamber 30 does not need to be replaced in case of repeated use.

Figure 5:
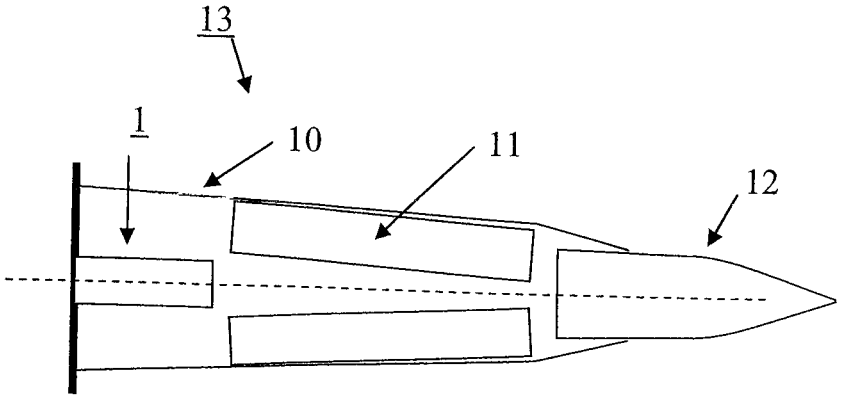
FIG. 5 shows in schematic representation a section of an ammunition unit comprising a plasma generator according to the invention.

FIG. 5 shows an encased ammunition unit 13 with integrated plasma generator. The plasma generator 1 is mounted in a cartridge case 10, together with a propellent charge 11 and a projectile 12. The propellent charge 11 can be, for example, a solid gunpowder comprising at least one charge unit in the form of one or more cylindrical rods, discs, blocks, etc. The charge units are multiperforated with a greater number of burning channels, so that a so-called multiholed gunpowder is obtained. Alternative embodiments of the propellent charge 11 are, of course, possible.

The functioning and use of the plasma generator 1 according to the invention are as follows:

Upon firing and initiation of the plasma generator 1, the capacitors 120, 121 charged by the high-voltage generator 2 are brought to be discharged by the circuit breaker 130. The capacitors 120, 121 are connected to the ionizing electrodes 100, 101, 102, 103, and the charge redistribution upon discharging of the capacitors results in ionization of the filler gas in the combustion chamber channel 3. When the degree of ionization is such that plasma generation can be initiated, then the second high-voltage generator 5 is brought to emit a strong electrical energy impulse comprising a high current strength and/or a high voltage, both with a certain defined amplitude and impulse length tailored to the properties applicable to the particular weapon, the temperature, the propellent charge, the projectile, the target, the environment, etc. The impedance of the plasma generator 1 in the active state, i.e. during plasma generation, is low, so that preferably a high current, in the order of magnitude of 10-100 kA, is generated from the second high-voltage generator 5, although, for a successful detonation, a high voltage, in the order of magnitude of 4-10 kV, is required. In order to produce an effective plasma, for detonation of a propellant bed, each energy impulse should exceed 1 kJ, but can amount to 30 kJ, and the plasma is supplied with an impulse length of between 1 μs and 10 ms.

The embodiment comprising a plurality of ionizing electrodes 100, 101, 102 and 103 which succeed one another in the combustion chamber channel 3 causes the electrical flashover between the rear electrode 22 and the front electrode 24 to move step by step between the ionizing electrodes. In the first flashover or discharge from the rear electrode 22 to the first ionizing electrode 100, UV light from the discharge will ionize the filler gas. In addition, the electrical field moves from the rear electrode 22 to the first ionizing electrode 100, which facilitates the next discharge from the ionizing electrode 100 to the ionizing electrode 101. In the discharge, too, between the ionizing electrodes 100 to 101, UV light is created for further ionization, as well as a further displacement of the electrical field. In the same way, the electrical flashover progresses to the front electrode 21. A very limited current will pass in the ionizing electrodes to earth, since the resistance to earth is high. The majority of the electrical energy in the high-voltage generator 5 will be discharged from the rear electrode 22 to the front electrode 21 and to the filler gas in the combustion chamber channel 3. The resistors have in the order of magnitude of 100 kOhm resistance in order to limit that part of the current which passes from the high-voltage generator 5 to earth via the ionizing electrodes 100, 101, 102, 103. When the initiation of the plasma generator 1 is realized by closure of the circuit breaker 130, a charged voltage in the capacitors 120 and 121 will be partially discharged to earth by virtue of the circuit breaker 130, at the same time as a charge redistribution takes place from the ionizing electrodes 100, 101, 102 and 103 and the capacitors 120 and 121. The charge redistribution from the ionizing electrode 100 is realized through the resistor 111 and the charge redistribution from the ionizing electrode 103 is realized through the resistor 112.

The strong electrical energy impulse will generate an electrical flashover, also referred to below as arc discharge, between the rear electrode 22 and the front electrode 21 via the ionizing electrodes 100, 101, 102, 103, and in the plasma channel which the arc discharge creates there is such a high temperature that the outermost surface layer/ply of the combustion chamber combustion element 30 melts, is vaporized and finally is ionized to a very hot plasma. In an alternative embodiment, a supplied combustion element to the combustion chamber channel 3 can be a part of the combustion element which forms plasma in connection with the arc discharge. It can also be the case that only the filler gas is ionized, in which case none of the combustion chamber combustion element 30 is consumed. Due to the high pressure which the vaporization generates in the combustion chamber channel 3, generated plasma-like gas is brought to spray out through the gas outlet 24, which gas outlet 24 is shaped as a nozzle. Impulse length, impulse shape, current strength and voltage can be varied according to the particular conditions at the moment of firing, such as the temperature of the environment, air humidity, etc., and for the specific characteristics of the present weapon system and of the ammunition or projectile type, as well as the particular type of target, inclusive of the distance to the said target.

A plasma generator with variable ignition energy enables instantaneous detonation of the whole of the propellent charge, whereby an immediate pressure increase is made possible. A plasma generator also has the advantage that, unlike a pyrotechnic initiator, the ignition energy can be varied over time. Variable ignition energy means that the ignition energy can be tailored to different types and sizes of propellent charges in order to vary the firing distance of the projectile, and also to compensate for the temperature dependency of the propellent charge. The energy quantity with which the high-voltage generator 5 is charged is adapted on the basis of the size and performance of the plasma generator 1. As soon as the impedance in the electrical flashover from the rear electrode 22, via the ionizing electrodes 100, 101, 102, 103, to the front electrode 21 approaches zero, then no electrical energy is any longer supplied to the plasma channel. Once no energy is being supplied to the plasma channel, then the impulse from the high-voltage generator 5 can be cut off, terminated or preferably adapted to the energy quantity in the high-voltage generator 5, such that, when the impedance in the electrical flashover approaches zero, then the high-voltage generator 5 is also discharged. In this way, the plasma generator 1 is energy-optimized.

Weapon systems can be ignited more easily and more reliably with the proposed repeatable plasma generator. The avoidance of sensitive primers and priming cartridges means that the full use of low-vulnerability propellants can be introduced. Problems with vulnerable mechanics as the mechanism for changing a priming cartridge or dosing apparatus for liquids can be avoided. The technique results in increased control of the ignition impulse in respect of parameters such as energy content, impulse length and lighting time. The ignition impulse can be adaptively adjusted to the size of the propellent charge, depending on the quantity of propellant, the vulnerability of the propellant and the ambient temperature.

An example of a plasma generator according to the invention, intended for use in an ordnance system as replacement for a conventional priming cartridge, is a combustion chamber combustion element 30 dimensioned to a thickness of about 1-30 mm, with which layer-by-layer vaporization of the combustion chamber combustion element has been achieved with an energy impulse of about 1-10 kJ of a few milliseconds duration and voltage within the range 5-10 kVolt. Current strength within the range 1-50 kA. Distance between the front electrode 21 and the rear electrode 22 was in the order or magnitude of 20-100 mm.

The invention is not limited to the specifically shown embodiments, but can be varied in different ways within the scope of the patent claims.

It will be appreciated, for example, that the number, the size, the material and the shape of the elements and parts included in the ammunition unit and the plasma generator are tailored to the weapon system(s) and other design characteristics which currently exist.

It will be appreciated that the above-described ammunition embodiment can comprise many different dimensions and projectile types, depending on the field of use and barrel width. Above, however, reference is made to at least the currently most commonly found projectiles of between about 25 mm and 160 mm.

In the above-described embodiments, the plasma generator comprises only a front gas outlet, but it falls within the inventive concept to provide more such openings along the surface of the combustion chamber channel or a plurality of openings in the front opening 24.

The plasma generator is repeatable, but can also be used in a single-use version, for example in an ammunition application, primer for a combat part or initiation of rocket motors.

The invention claimed is:

1. A plasma generator for the repeatable initiation of propellant charges in a weapon system through electrical discharge between a rear electrode and a front electrode in a combustion chamber channel, comprised in a combustion chamber combustion element and filled with filler gas, and disposed adjacent to a propellant charge, wherein the plasma generator comprises at least one ionizing electrode connected to an initiation circuit for ionizing the filler gas in the combustion chamber channel to raise the conductivity of the filler gas, as well as a second high-voltage generator arranged for electrical discharge into the filler gas of raised conductivity from the rear electrode via the at least one ionizing electrode onward to the front electrode, so that hot ignition gas is formed under high pressure.

2. The plasma generator according to claim 1, wherein the initiation circuit comprises at least a first high-voltage generator and at least one circuit breaker connected to a first terminal of at least one capacitor, wherein the at least one ionizing electrode connected to the initiation circuit is connected to a second terminal of the said capacitor by at least one resistor comprised in an electrical circuit.

3. The plasma generator according to claim 2, the initiation circuit, in addition to the resistor connected to the second terminal of the capacitor, comprises at least one inductor connected between the at least one ionizing electrode connected to the initiation circuit and the resistor.

4. The plasma generator according to claim 1 wherein the at least one ionizing electrode is fixed to the combustion chamber combustion element, wherein the at least one ionizing electrode is in open contact with the combustion chamber channel and is electrically connected to the initiation circuit.

5. The plasma generator according to claim 1, wherein the at least one ionizing electrode is distributed with mutually equal spacing in the axial direction of the combustion chamber channel.

6. The plasma generator according to claim 1, wherein the at least one ionizing electrode is distributed with equal spacing around the center axis of the combustion chamber channel.

7. The plasma generator according claim 1, wherein the at least one ionizing electrode is four in number.

8. The plasma generator according to claim 1, wherein the rear electrode is disposed on a rear end of the combustion chamber channel and is electrically connected to the second high-voltage generator, and the front electrode is disposed on a front end of the combustion chamber channel and is connected to earth, which rear and front electrodes are made of an electrically conducting material, and in the front electrode is disposed a gas outlet, which opens out towards the propellant charge.

9. The plasma generator according to claim 8, wherein the gas outlet is a convergent nozzle.

10. The plasma generator according to claim 8, wherein the gas outlet is a divergent nozzle.

11. The plasma generator according to claim 8, wherein the gas outlet is a convergent-divergent nozzle.

12. The plasma generator according to claim 1, wherein the combustion chamber combustion element is made of a material which is not consumed upon the initiation of the plasma generator.

13. An ammunition unit comprising a shell casing, a projectile, a propellant charge and a priming device, wherein the priming device is constituted by a plasma generator according to claim 1.

* * * * *